US005768734A

United States Patent [19]

Dietrich

[11] Patent Number: 5,768,734

[45] Date of Patent: Jun. 23, 1998

[54] SWIMMING POOL VACUUM

[76] Inventor: Dan Dietrich, 238 SE. 7th Ave., Delray Beach, Fla. 33483

[21] Appl. No.: 759,558

[22] Filed: Dec. 4, 1996

Related U.S. Application Data

[60] Provisional application No. 60/008,201 Dec. 5, 1995.

[51] Int. Cl.[6] ..... E04H 4/16

[52] U.S. Cl. ..... 15/1.7; 210/169

[58] Field of Search ..... 15/1.7; 210/169, 210/238, 241, 416.2

[56] References Cited

U.S. PATENT DOCUMENTS

| | | | |
|---|---|---|---|
| 2,725,356 | 11/1955 | Lombardi | 15/1.7 |
| 3,075,227 | 1/1963 | Bowles | 15/1.7 |
| 3,444,575 | 5/1969 | Martin | 15/1.7 |
| 3,755,843 | 9/1973 | Goertzen et al. | 15/1.7 |
| 3,961,393 | 6/1976 | Pansini | 15/1.7 |
| 4,052,950 | 10/1977 | Hirata | 15/1.7 |
| 4,589,986 | 5/1986 | Greskovics | 15/1.7 |
| 4,880,531 | 11/1989 | Blake et al. | 15/1.7 |
| 4,950,393 | 8/1990 | Goettl | 15/1.7 |
| 5,603,135 | 2/1997 | Jones et al. | 15/1.7 |

*Primary Examiner*—Terrence Till
*Attorney, Agent, or Firm*—Robert M. Downey, PA

[57] ABSTRACT

A self-contained swimming pool vacuum includes a submersible vacuum head having a housing including opposing symmetrical halves which attach together to define an elongate vacuum mouth at a bottom end, a discharge opening at the opposite upper ends and a thrust channel extending therebetween. A motor supported within the thrust channel when the symmetrical halves of the housing are joined together, drives a propeller to create a thrust through the housing from the vacuum mouth through the thrust channel and out from the discharge opening at the top of the housing. A catch bag, removably secured to the top discharge opening, collects debris sucked through the vacuum mouth. First and second primary wheels are rotatably mounted on opposite ends of the housing, adjacent the vacuum mouth, to provide a cantilever effect when maneuvering the vacuum head along a surface. The housing is further provided with drag wheels on opposing leading and trailing edges and a swivel yoke mount structured for attachment to a hollow pole to manipulate the submerged vacuum head about the surfaces of a swimming pool.

15 Claims, 2 Drawing Sheets

SWIMMING POOL VACUUM

This application claims priority on provisional application 60/008,201, filed Dec. 5, 1995.

FIELD OF THE INVENTION

The present invention relates to pool vacuums and, specifically, to a self-contained pool vacuum including a submersible vacuum head having a housing with an electric motor and propeller mounted therein to create a suction force at an open mouth of the vacuum head.

BACKGROUND OF THE INVENTION

The ordinary care and maintenance of swimming pools requires regular vacuuming of the bottom to remove dirt, leaves, and other debris. A common pool vacuum system employs the use of an elongate flexible hose which attaches at one end to a vacuum head on a pole and to the pool's skimmer intake at an opposite end. Upon activation of the pump of the pool's filter system, water is drawn through the skimmer intake creating a suction at the vacuum head. By maneuvering the vacuum head, using the pole, along the bottom pool surface, dirt and other debris is drawn through the hose and into the filter system. Larger debris, such as leaves, sticks, paper and the like is trapped in a basket in the filter system. After vacuuming the pool, it is thereafter necessary to disconnect and rinse the hose with fresh water to prevent damage caused by the chemicals in the pool. The filter basket in the pool's filter system must then be removed and cleaned so that water flow through the filter system is not obstructed.

Commercial pool cleaning services, which typically clean from between 20 to 40 pools per day, prefer not to use the above-described vacuuming method, as it is somewhat laborious and time-consuming. In recent years, many commercial pool services have begun using self-contained submersible vacuum heads which attach to the end of a convention aluminum pole. The vacuum head plugs into an electric power source to energize a motor mounted within the vacuum head. The motor drives a propeller which creates a thrust through the vacuum head, drawing dirt, leaves, and other debris through the vacuum head and into an attached catch bag. Once the pool has been vacuumed, the vacuum head is lifted and removed from the pool and the catch bag is detached and cleaned. Use of such submersible vacuum heads has proven to be cost-effective and efficient to many commercial pool cleaning services.

In spite of the many benefits realized with the use of submersible vacuum heads versus the conventional pool vacuum system which connects by a hose to the pool's filter system, the heavy workload in a commercial environment subjects the electric motor in the vacuum head to a great deal of abuse. It has been found that in most cases, under normal working conditions, the motors will last approximately 12 months. Once the motor burns out, it is necessary to replace a new motor in the vacuum head. The existing designs of submersible vacuum heads now being used in the commercial pool cleaning industry require motor mounting brackets which use a significant amount of hardware. To remove and replace a burned out motor, it is necessary to completely disassemble the mounting brackets located with the housing of the vacuum head, as well as a waterproof wire connection casing. A new motor must then be positioned within the vacuum head and the mounting bracket and waterproof wire connection casing reassembled to secure the motor in the proper fixed position. This has proven to be a tedious and labor intensive task, resulting in a substantial amount of "down time." For a pool service technician having a rigorous schedule of 20–40 pools per day, the time required to replace a motor in the vacuum head can present a stressful and costly interruption to his/her schedule.

Another problem commonly associated with the presently used submersible vacuum heads is the restricted maneuverability about the pool bottom. The wheel brackets and wheel swivels used on these devices require a great deal of effort to turn the vacuum head, using the pole, to change direction along the pool bottom surface. The suction of the round mouth towards the pool surface results in even greater resistance to movement and turning. This difficulty in maneuvering the vacuum head results in a greater amount of time and physical effort needed in order to fully vacuum the pool. In a commercial environment, this added pool cleaning time and labor will have a direct effect on the number of pools which can be cleaned per day and thus, resulting in a loss of potential revenue.

SUMMARY OF THE INVENTION

A self-contained swimming pool vacuum includes a submersible vacuum head having a housing including opposing symmetrical halves which attach together to define an elongate vacuum mouth at a bottom end, a discharge opening at the opposite upper ends and a thrust channel extending therebetween. A motor supported within the thrust channel when the symmetrical halves of the housing are joined together, drives a propeller to create a thrust through the housing from the vacuum mouth through the thrust channel and out from the discharge opening at the top of the housing. A catch bag, removably secured to the top discharge opening, collects debris sucked through the vacuum mouth. First and second primary wheels are rotatably mounted on opposite ends of the housing, adjacent the vacuum mouth, to provide a cantilever effect when maneuvering the vacuum head along a surface. The housing is further provided with drag wheels on opposing leading and trailing edges and a swivel yoke mount structured for attachment to a hollow pole to manipulate the submerged vacuum head about the surfaces of a swimming pool.

OBJECTS AND ADVANTAGES OF THE INVENTION

In accordance with the features and design of the present invention, as more specifically described in the detailed description which follows, it is a primary object of the present invention to provide a submersible pool vacuum head comprising a housing and motor supported therein, wherein the vacuum head is specifically structured to facilitate quick removal and replacement of the motor, and thereby substantially reducing down time.

It is a further object and advantage of the present invention to provide a submersible pool vacuum head having a housing and an electric motor mounted therein, wherein the housing includes a pair of symmetrical halves structured for mating attachment to define an elongate vacuum mouth and thrust channel in fluid communication therewith.

It is still a further object of the present invention to provide a submersible pool vacuum head having a motor supported within a housing thereof, wherein the housing is specifically structured to support the motor within a thrust channel in a manner which facilitates quick and easy removal and replacement of the motor without the necessity of separate mounting brackets and hardware.

It is still a further object of the present invention to provide a submersible pool vacuum head including a symmetrical housing and electric motor mounted therein, wherein the motor includes a water tight electrical connection, thereby extending the life of the motor.

It is yet a further object of the present invention to provide a submersible pool vacuum head having a housing and electric motor and propeller supported therein, and wherein the vacuum head includes a cantilevered drive wheel assembly specifically structured to overcome the problems of maneuverability associated with the vacuum heads of the related art, and to protect the housing from wear and abrasion.

It is still another object of the present invention to provide an enlarged, elongate vacuum mouth on a self-contained submersible pool vacuum head to increase the vacuum area and maneuverability of the vacuum head, thereby maximizing the efficiency of the apparatus.

It is another object of the present invention to provide a submersible vacuum head as described above and including oppositely disposed drag wheels to promote movement of the vacuum head over all surfaces of a swimming pool including radius surfaces at the junction between the bottom and walls of a pool.

These and other objects and advantages will be more readily apparent in the description which follows.

BRIEF DESCRIPTION OF THE DRAWINGS

For a fuller understanding of the nature of the present invention, reference should be had to the following detailed description taken in connection with the accompanying drawings in which.

Like reference numerals refer to like parts throughout the several views of the drawings.

DETAILED DESCRIPTION OF THE PREFERRED EMBODIMENT

Figure 2:
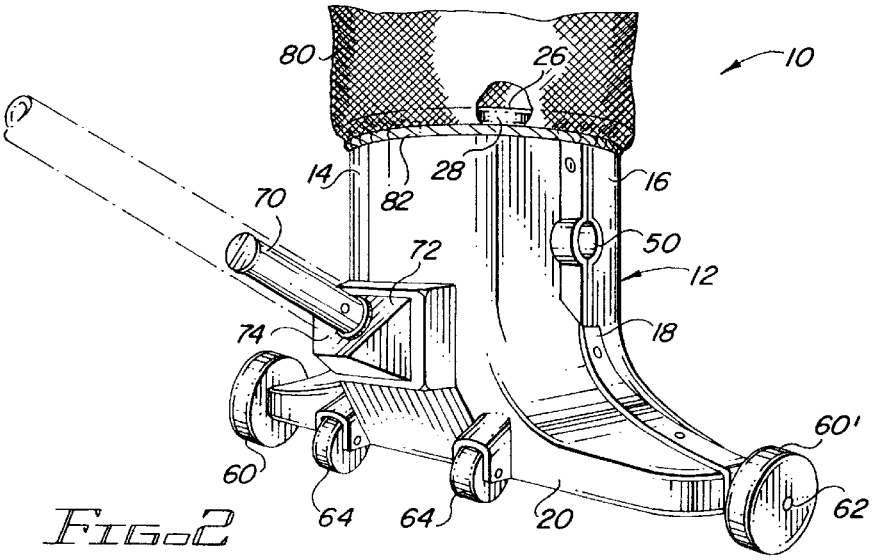
FIG. 2 is a front perspective view of the vacuum head housing.
Figure 3:
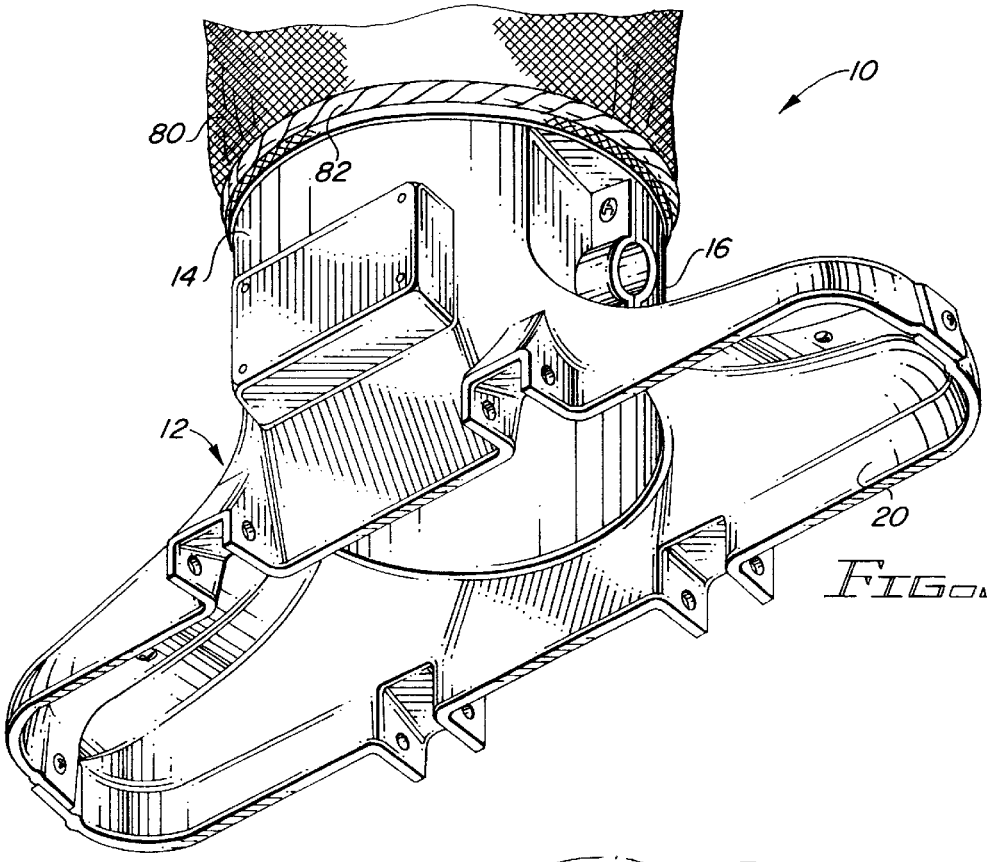
FIG. 3 is a bottom perspective view of the vacuum head housing showing an elongate vacuum mouth thereof.

Referring to the several views of the drawings, there is illustrated the pool vacuum head assembly 10 of the present invention. As seen throughout the several views, the vacuum head assembly 10 includes a housing 12 having a pair of symmetrical halves 14, 16 which join together along corresponding flanges 18, 18'. When the symmetrical halves 14, 16 of the housing 12 are joined together, as seen in FIGS. 2 and 3, there is defined an elongate vacuum mouth 20 at the bottom of the housing 12, a centrally disposed thrust channel 24 which extends through the housing 12 from the elongate mouth 20 to discharge opening 26 having an annular rim 28 thereabout.

Figure 1:
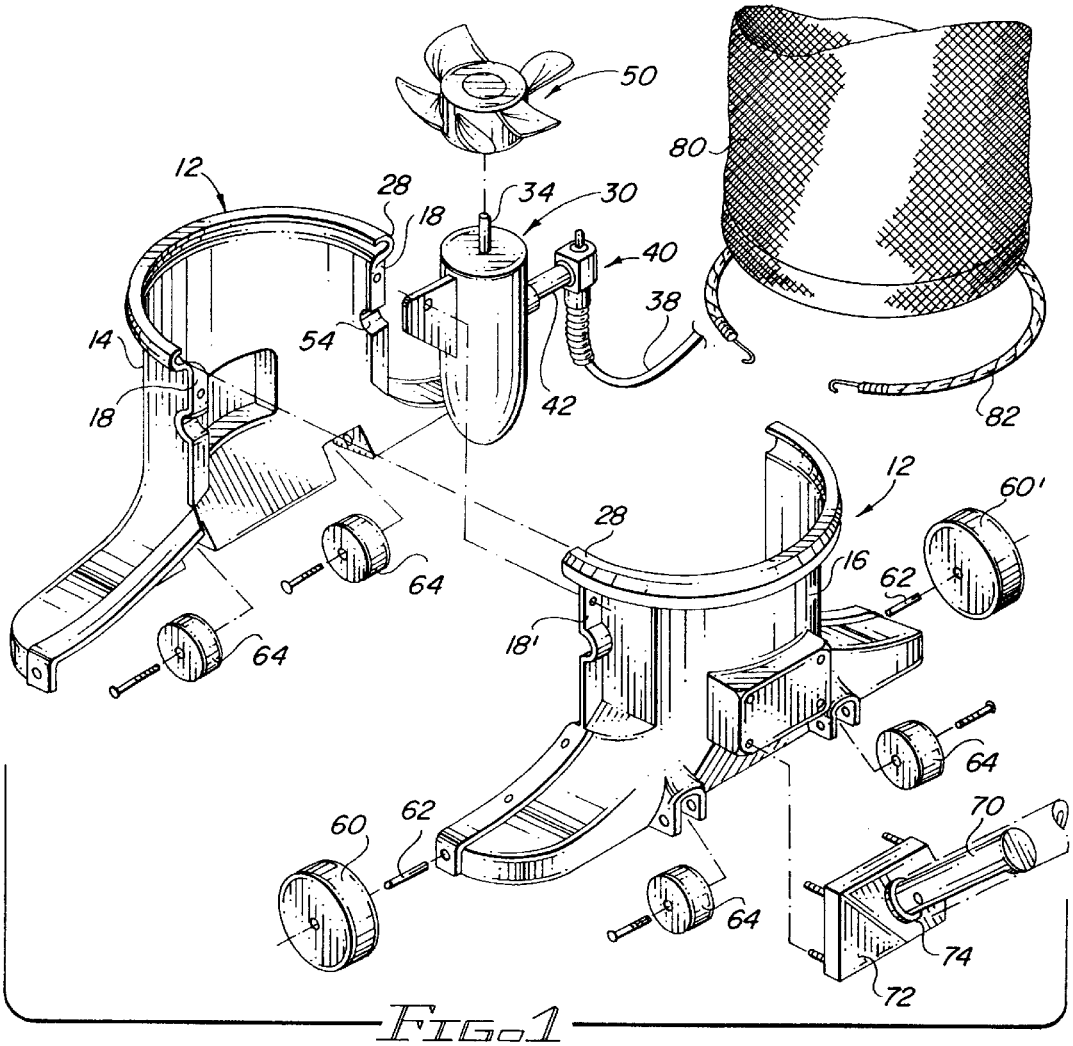
FIG. 1 is an exploded perspective view of the vacuum head assembly of the present invention.
Figure 4:
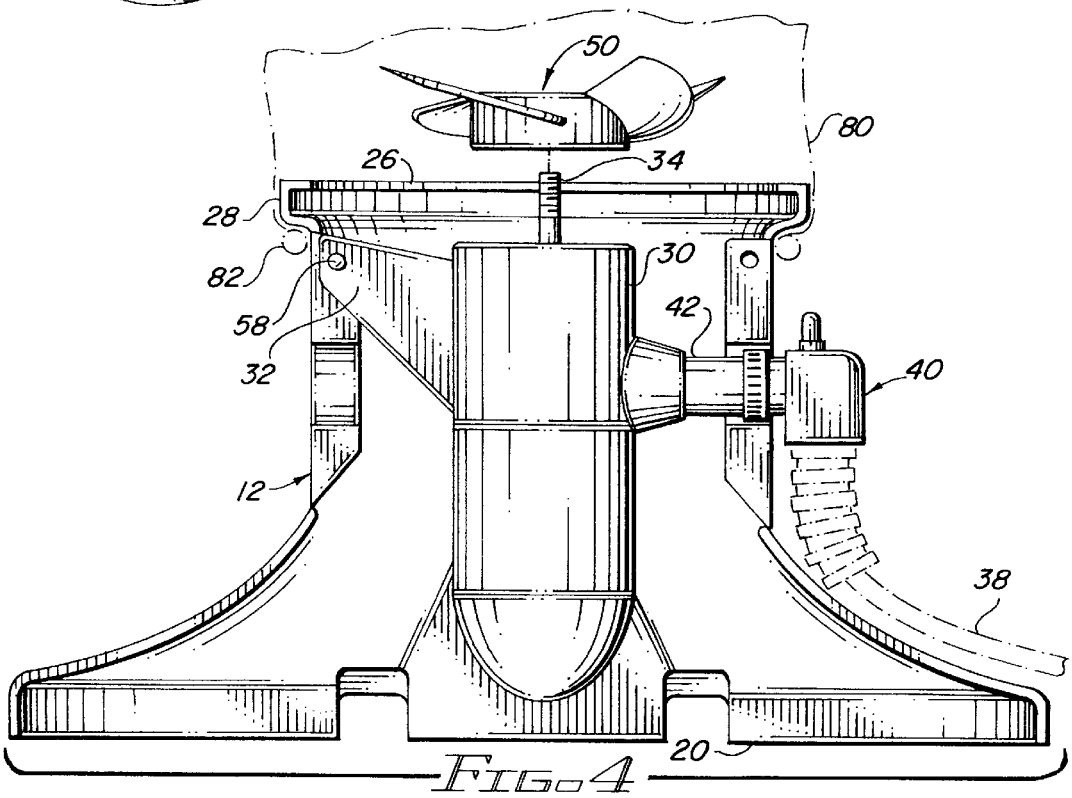
FIG. 4 is a front elevation of a halve of the housing, partially exploded, showing the motor supported with an interior thrust channel of the vacuum head housing.

As seen in FIGS. 1 and 4, the vacuum head assembly 10 further includes an electric motor unit 30 having a flange 32 extending therefrom and an axial shaft 34 rotatably driven by the motor unit 30. The motor unit 30 is powered by 12 volt power via an electrical conductor 38. The conductor 38 is attached to the motor unit 30 via a pressurized valve fitting 40. The pressurized valve fitting 40 connects in water tight relation to a stem 42 extending from the motor unit. The pressurized fitting provides a water tight electrical connection between the motor unit 30 and the conductor 38.

A propeller 50 of predetermined pitch is fitted to the shaft 34 extending from the motor unit 30 and is rotatably driven thereby upon activation of the motor unit 30.

As best seen in FIG. 4, the motor unit 30 is conveniently and easily mounted within the thrust channel 24 of the housing 12 by securing the flange 32 of the motor unit 30 to the flange 18, 18' of the symmetrical housing halves 14, 16. At the opposite side of the thrust channel, the stem 42 extending from the motor unit 30 is fitted through a port 54 formed in the mating flanges 18, 18' of the housing 12 to further support the motor unit 30 within the thrust channel 24 of the housing.

To remove the motor unit 30, the housing halves 14, 16 are simply partially separated and a screw or other fastener 58 securing the flange 32 of the motor unit 30 to the housing 12 is removed. With the housing halves 14, 16 partially separated, the stem 42 and the motor unit 30 can easily be lifted up through the discharge opening 26 at the top of the housing 12. A new motor or the repaired motor 30 can thereafter be positioned in place for mounting in the thrust channel 24.

Upon activation of the motor unit 30, the propeller 50 is driven to create a thrust through the thrust channel 24, causing suction at the vacuum mouth 20. Debris is drawn through the vacuum mouth 20, through the thrust channel 24, and into an attached catch bag 80 on the discharge opening 26 of the housing. The elongate mouth 20 design increases the pick-up area and maneuverability of the vacuum head, thereby maximizing the efficiency of the assembly.

Another important feature of the present invention is the wheel assembly which maintains the vacuum mouth 20 at a predetermined optimum distance in spaced relation to the surface being cleaned, while also increasing the maneuverability of the vacuum head. The wheel assembly includes primary wheels 60, 60' which mount at opposite ends of the vacuum mouth on axles or pins 62. This cantilevered mounting facilitates easy turning of direction of the vacuum head assembly 10 using an extension pole. Drag wheels 64 are further provided on opposite forward and rear edges of the vacuum mouth. The drag wheels are rotatably mounted to the housing halves 14, 16, and positioned to facilitate movement over rounded surfaces of the pool bottom, walls, steps, and the like.

A yoke 70 structured for removable attachment of a conventional elongate pole thereto is fitted to a yoke mount 72 with a swivel fitting 74, permitting the yoke 70 to rotate relative to the yoke mount 72 and the housing 12. Each of the halves 14, 16 of the housing 12 are provided with a flat protruding mount surface. The yoke mount is selectively attached in fixed relation on either of the flat mounting surfaces of one of the housing halves 14, 16.

The peripheral rim 28 about the discharge 26 of the housing 12 permits a mesh catch bag 80 to be secured over the discharge opening 26. An open end of the catch bag 80 is fitted over the discharge opening 26 so that the peripheral rim 28 is within the bag 80. An elastic band 82, bungee cord, or like securing element fits over the peripheral rim to hold the bag 80 against the exterior surface of the housing just below the peripheral rim 28.

While the instant invention has been shown and described in what is considered to be a preferred and practical embodiment thereof, it is recognized that departures may be made within the spirit and scope of the invention which is, therefore, not to be limited except as set forth within the following claims and under the doctrine of equivalents.

Now that the invention has been described,

What is claimed is:

1. A pool vacuum head assembly attachable to an elongate pole for picking up debris within a body of water, comprising:

a housing having first and second halve portions, means for removably attaching said halve portions in joined relation to form an integral housing unit, said housing unit, with said halve portions joined together, including a discharge opening at a top end surrounded by an annular rim, an open elongate vacuum mouth at an opposite bottom end and a surrounding wall structure defining a thrust channel extending from said open elongate vacuum mouth to said discharge opening, thrust means for creating a forced flow of water through said thrust channel from said vacuum mouth to said discharge opening when said housing is submerged in the body of water, resulting in a negative pressure at said vacuum mouth to create a suction force sufficient to pull water and debris through said vacuum mouth and said thrust channel and out from said discharge opening, catch means at said discharge opening for catching and retaining the debris exiting said discharge opening, and a yoke on said housing, said yoke being structured for removable attachment of the elongate pole thereto so that said housing can be manipulated within the body of water.

2. A pool vacuum head assembly as recited in claim 1 further including roller means for permitting movement and maneuverability of said housing along a surface within the body of water so that the vacuum mouth is maintained at a predetermined distance relative to the surface.

3. A pool vacuum head assembly as recited in claim 2 wherein said roller means includes wheels including a primary wheel assembly having first and second primary wheels rotatably mounted at opposite ends of said vacuum mouth and a plurality of drag wheels rotatably mounted at spaced intervals along a forward leading edge and a rearward trailing edge of said elongate vacuum mouth.

4. A pool vacuum head assembly as recited in claim 1 wherein said means for attaching said halve portions includes corresponding, mating flanges on each of said halve portions extending from said elongate mouth opening to said annular rim, said corresponding flanges on each of said halve portions being structured and disposed for mating attachment to define said integral housing unit.

5. A pool vacuum head assembly as recited in claim 1 further including mount means for mounting said thrust means within said thrust channel.

6. A pool vacuum head assembly as recited in claim 5 wherein said thrust means includes a propeller fixed to a shaft and a motor for drivingly rotating said shaft and propeller to create the forced flow of water through said thrust channel and the suction force.

7. A pool vacuum head assembly as recited in claim 1 wherein said yoke includes a swivel fitting permitting said yoke to rotate relative to said housing.

8. A pool vacuum head assembly as recited in claim 1 wherein said catch means includes a catch bag having an open end sized and configured for receipt over said discharge opening and means for securing said catch bag over said discharge opening so that said annular rim is within said catch bag.

9. A pool vacuum head assembly attachable to an elongate pole for picking up debris within a body of water, comprising:

a housing having first and second halve portions, means for removably attaching said halve portions in joined relation to form an integral housing unit, said housing unit, with said halve portions joined together, including a discharge opening at a top end surrounded by an annular rim, an open elongate vacuum mouth at an opposite bottom end and a surrounding wall structure defining a thrust channel extending from said open elongate vacuum mouth to said discharge opening, thrust means for creating a forced flow of water through said thrust channel from said vacuum mouth to said discharge opening when said housing is submerged in the body of water, resulting in a negative pressure at said vacuum mouth to create a suction force sufficient to pull water and debris through said vacuum mouth and said thrust channel and out from said discharge opening, catch means at said discharge opening for catching and retaining the debris exiting said discharge opening, roller means for permitting movement and maneuverability of said housing along a surface within the body of water so that the vacuum mouth is maintained at a predetermined distance relative to the surface, and a yoke on said housing, said yoke being structured for removable attachment of the elongate pole thereto so that said housing can be manipulated within the body of water.

10. A pool vacuum head assembly as recited in claim 9 wherein said roller means includes wheels including a primary wheel assembly having first and second primary wheels rotatably mounted at opposite ends of said vacuum mouth and a plurality of drag wheels rotatably mounted at spaced intervals along a forward leading edge and a rearward trailing edge of said elongate vacuum mouth.

11. A pool vacuum head assembly as recited in claim 9 wherein said means for attaching said halve portions includes corresponding, mating flanges on each of said halve portions extending from said elongate mouth opening to said annular rim, said corresponding flanges on each of said halve portions being structured and disposed for mating attachment to define said integral housing unit.

12. A pool vacuum head assembly as recited in claim 9 further including mount means for mounting said thrust means within said thrust channel.

13. A pool vacuum head assembly as recited in claim 12 wherein said thrust means includes a propeller fixed to a shaft and a motor for drivingly rotating said shaft and propeller to create the forced flow of water through said thrust channel and the suction force.

14. A pool vacuum head assembly as recited in claim 9 wherein said yoke includes a swivel fitting permitting said yoke to rotate relative to said housing.

15. A pool vacuum head assembly as recited in claim 9 wherein said catch means includes a catch bag having an open end sized and configured for receipt over said discharge opening and means for securing said catch bag over said discharge opening so that said annular rim is within said catch bag.

* * * * *